US009622513B2

(12) United States Patent
Fisher et al.

(10) Patent No.: US 9,622,513 B2
(45) Date of Patent: Apr. 18, 2017

(54) CUFF FOR CLOTHING ARTICLE

(71) Applicant: Nike, Inc., Beaverton, OR (US)

(72) Inventors: Kimberly R. Fisher, Beaverton, OR (US); Lindsey V. J. Martin, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 340 days.

(21) Appl. No.: 14/296,912

(22) Filed: Jun. 5, 2014

(65) Prior Publication Data

US 2015/0351458 A1 Dec. 10, 2015

(51) Int. Cl.

| | |
|---|---|
| ***A41B 7/00*** | (2006.01) |
| ***A41B 7/02*** | (2006.01) |
| *A41F 17/00* | (2006.01) |

(52) U.S. Cl.

CPC ..... *A41B 7/02* (2013.01); *A41F 17/00* (2013.01)

(58) Field of Classification Search

CPC ..... A63B 71/14; A63B 71/141; A63B 71/145; A61F 13/07; A61F 13/10; A61F 13/102; A61F 13/104; A61F 13/105; A61F 13/107; F41B 5/1473; A41D 13/08–13/088; A41D 20/00

See application file for complete search history.

(56) References Cited

U.S. PATENT DOCUMENTS

| | | | |
|---|---|---|---|
| 301,640 | A | 7/1884 | Swan |
| 4,924,529 | A | 5/1990 | Grilliot et al. |
| 5,504,944 | A | 4/1996 | Bromer et al. |
| 2014/0090144 | A1 | 4/2014 | Gilreath |

OTHER PUBLICATIONS

International Search Report with Written Opinion dated Aug. 6, 2015 in Application No. PCT/US2015/033780, 11 pages.

*Primary Examiner* — Khaled Annis

(74) *Attorney, Agent, or Firm* — Shook, Hardy & Bacon L.L.P.

(57) ABSTRACT

A cuff for an article of clothing includes various components, such as one or more flexible members for adjusting a fit of the cuff. One flexible member might be used to tighten and loosen a fit of the cuff. Another flexible member might serve a dual purpose to adjust a fit of the cuff and to provide a thumb loop.

15 Claims, 5 Drawing Sheets

CUFF FOR CLOTHING ARTICLE

CROSS-REFERENCE TO RELATED APPLICATIONS

Not applicable.

TECHNICAL FIELD

A cuff including one or more components for adjusting a fit of the cuff and securing the cuff to a wearer.

BACKGROUND

Clothing articles, such as a shirt, sweatshirt, jacket, or coat, often include a cuff at or near an arm-sleeve opening. Various clothing features might be used to adjust the fit of the cuff or to secure the cuff to a wearer. For instance, elastic or Velcro straps might be included near the sleeve opening. In addition, a clothing article might include a thumb hole or a thumb loop that is constructed into the cuff or the sleeve.

BRIEF SUMMARY

Aspects hereof provide an arm sleeve for an article of clothing. The sleeve includes a tubular sleeve body that extends from a torso portion and includes a terminating end. One or more releasable fasteners are coupled to the tubular sleeve body near the terminating end. In addition, a first flexible member is coupled to the tubular sleeve body near the terminating end and is releasably attachable to the one or more releasable fasteners. A second flexible member is rotatably coupled to the tubular sleeve body near the terminating end and releasably attachable to the one or more releasable fasteners.

Additional aspects provide a cuff for an apparel sleeve. The cuff includes a cuff wall and one or more releasable fasteners coupled to an outer surface of the cuff wall. In addition, a first flexible member is coupled to the outer surface and is releasably attachable to the one or more releasable fasteners. The attachment of the first flexible member to the one or more releasable fastener is adjustable to modify a size of the cuff. The cuff also includes a second flexible member rotatably coupled to the cuff wall and including a first position and a second position. In the first position the second flexible member is substantially aligned with the first flexible member and is releasably attachable to the one or more releasable fasteners. In the second position the second releasable fastener is attachable to the one or more releasable fasteners to provide a thumb loop.

Another aspect includes a cuff for an apparel sleeve. The cuff includes a cuff wall and one or more releasable fasteners coupled to an outer surface of the cuff wall. The cuff also includes a first strap having a first substantially flat and elongated fabric strip, which is attached along a first edge to the outer surface of the cuff wall and is releasably attachable to the one or more releasable fasteners. The attachment of the first strap to the one or more releasable fastener is adjustable to modify a size of the cuff. In addition, the cuff includes a second strap comprising a second substantially flat and elongated fabric strip coupled to an elastic joint, which rotatably attaches the second fabric strip to the cuff wall. The second strap adjusts by way of the elastic joint between at least a first position, in which the second strap is substantially aligned with the first strap, and a second position, in which the second strap provides a thumb loop.

Aspects hereof are defined by the claims below, not this summary. A high-level overview is provided to merely introduce a selection of concepts that are further described below in the detailed-description section. This summary is not intended to identify key or essential features of the claimed subject matter, nor is it intended to be used as an aid in isolation to determine the scope of the claimed subject matter.

BRIEF DESCRIPTION OF THE DRAWINGS

Aspects hereof are described in detail herein with reference to the attached figures, which are incorporated herein by reference, wherein.

DETAILED DESCRIPTION

Subject matter is described with specificity herein to meet statutory requirements. But the description itself is not intended to necessarily limit the scope of claims. Rather, the claimed subject matter might be embodied in other ways to include different elements or combinations of elements similar to the ones described in this document, in conjunction with other present or future technologies.

Aspects hereof provide an arm sleeve for an article of clothing. The sleeve includes a tubular sleeve body that extends from a torso portion 3 and includes a terminating end. One or more releasable fasteners are coupled to the tubular sleeve body near the terminating end. In addition, a first flexible member is coupled to the tubular sleeve body near the terminating end and is releasably attachable to the one or more releasable fasteners. A second flexible member is rotatably coupled to the tubular sleeve body near the terminating end and releasably attachable to the one or more releasable fasteners.

Additional aspects provide a cuff for an apparel sleeve. The cuff includes a cuff wall and one or more releasable fasteners coupled to an outer surface of the cuff wall. In addition, a first flexible member is coupled to the outer surface and is releasably attachable to the one or more releasable fasteners. The attachment of the first flexible member to the one or more releasable fastener is adjustable to modify a size of the cuff. The cuff also includes a second flexible member rotatably coupled to the cuff wall and including a first position and a second position. In the first position the second flexible member is substantially aligned with the first flexible member and is releasably attachable to the one or more releasable fasteners. In the second position the second releasable fastener is attachable to the one or more releasable fasteners to provide a thumb loop.

Another aspect includes a cuff for an apparel sleeve. The cuff includes a cuff wall and one or more releasable fasteners coupled to an outer surface of the cuff wall. The cuff also includes a first strap having a first substantially flat and elongated fabric strip, which is attached along a first edge to the outer surface of the cuff wall and is releasably attachable to the one or more releasable fasteners. The attachment of the first strap to the one or more releasable fastener is adjustable to modify a size of the cuff. In addition, the cuff includes a second strap comprising a second substantially flat and elongated fabric strip coupled to an elastic joint, which rotatably attaches the second fabric strip to the cuff wall. The second strap adjusts by way of the elastic joint between at least a first position, in which the second strap is substantially aligned with the first strap, and a second position, in which the second strap provides a thumb loop.

Figure 1:
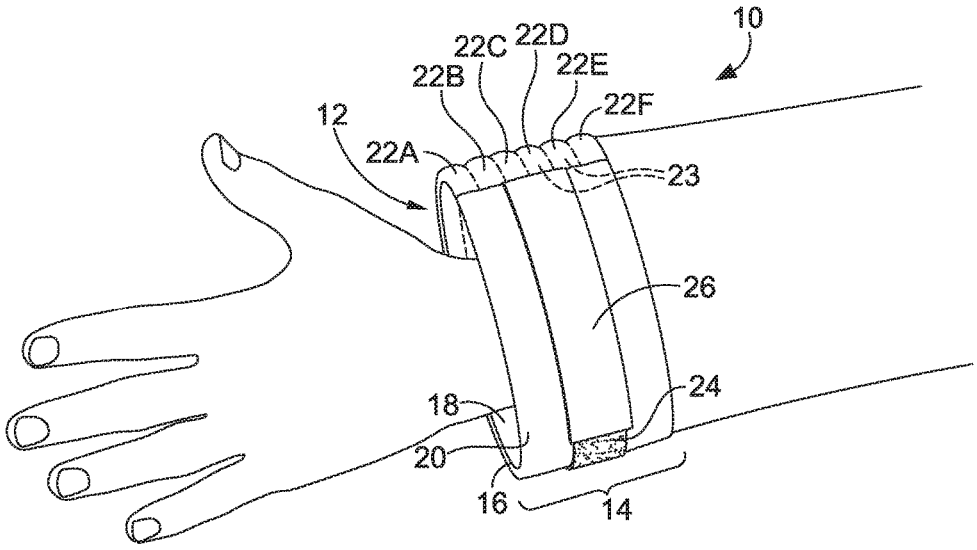
FIG. 1 depicts a first side of an exemplary sleeve in accordance with aspects hereof.
Figure 9:
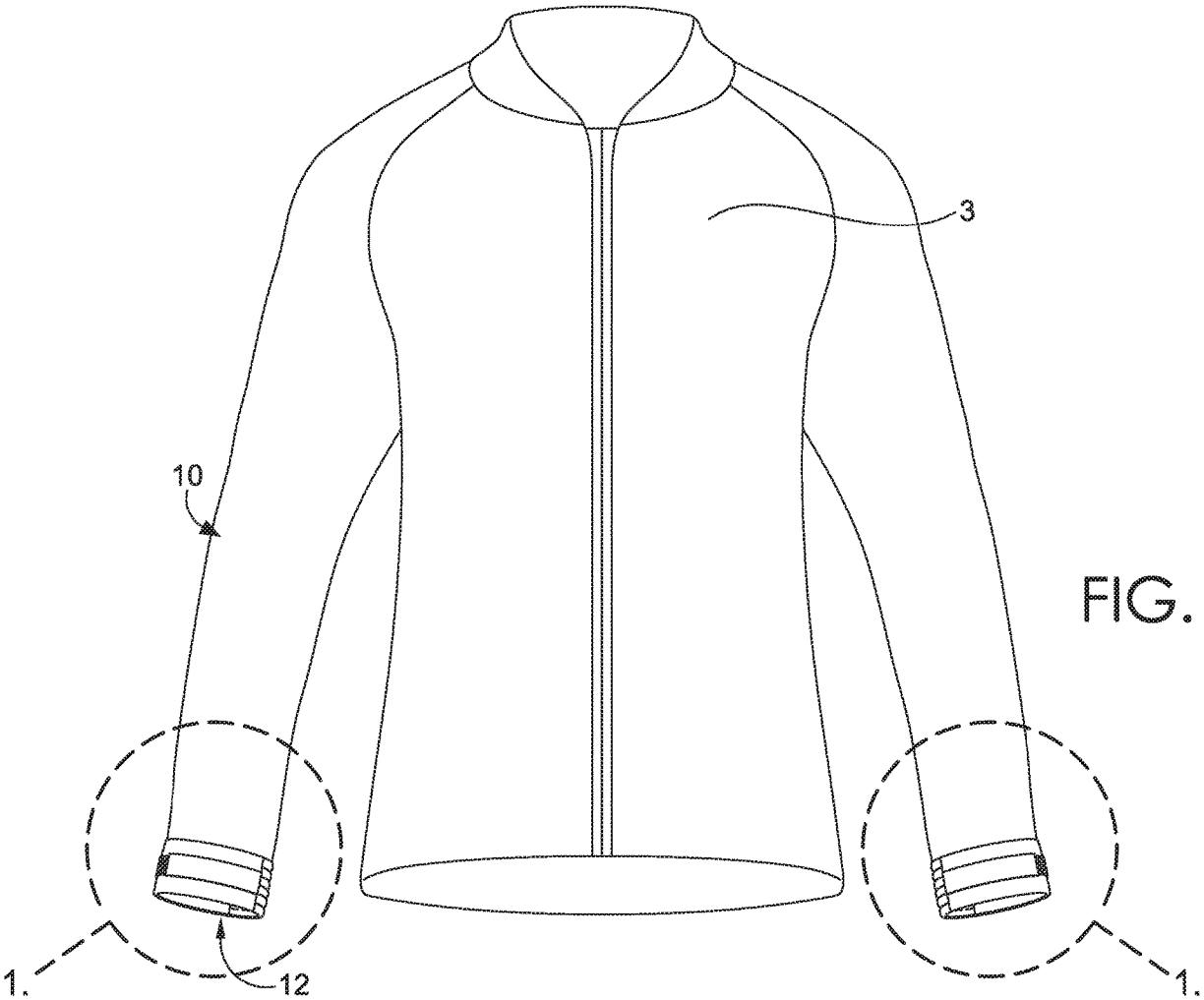

Having briefly described some aspects of the present invention, reference is now made to FIG. 9, which depicts an exemplary garment with a torso portion 3, sleeve 10, and terminating end 12. Turning to FIG. 1, the sleeve 10 is an arm sleeve of a clothing item, such as a shirt, sweatshirt, zip-up shirt, hoodie, jacket, coat, and the like. The terminating end 12 of the sleeve 10, includes a first volume of space 11 through which a hand, wrist, and arm can extend. The sleeve 10 may be constructed of a wide variety of textiles and fabric and may include a single type of textile or a combination of different textiles. In addition, the sleeve 10 may include one or more outer layers, inner layers, and insulating layers.

Near the terminating end 12, the sleeve 10 includes a cuff 14 having a cuff wall 16. The cuff wall 16 might include various constructions, and in one aspect the cuff wall includes an inner fabric layer 18 and an outer fabric layer 20. The inner fabric layer 18 and the outer fabric layer 20 might include a same type of fabric or textile that is folded on top of itself, or the inner and outer fabric layers 18 and 20 might include two different textile types that are affixed to one another. In one aspect, the cuff 14 includes one or more elastic members 23 that are positioned between the inner and outer fabric layers of the cuff 18 and 20. For example, FIG. 1 depicts illustrative tubes 22*a-f* that have been sewn into the cuff and one or more of the tubes includes a respective elastic member 23. Although the exemplary figures depict tubes 22*a-f* that might include elastic members 23, in other aspects the cuff does not include the elastic members 23.

In FIG. 1, the cuff 14 includes a releasable fastener 24, which includes a touch textile or hook-and-loop textile. Although FIG. 1 depicts an exemplary hook-and-loop textile, in other aspects the cuff 14 might include alternative releasable fasteners, such as snaps, buttons, and the like. In addition, the cuff 14 includes an outer flexible member 26 that is attachable to the releasable fastener 24.

Figure 2:
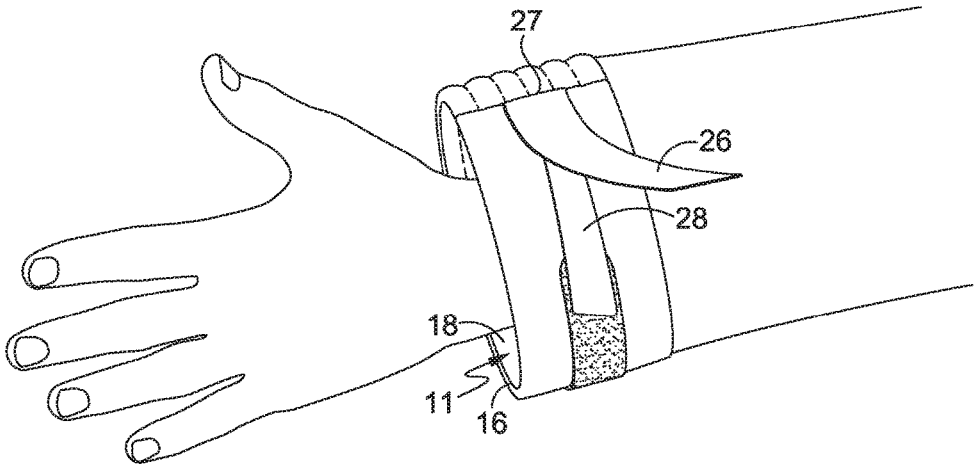
FIGS. 2-4 depict the first side of the sleeve with a first strap and a second strap in accordance with aspects hereof.

In one aspect the outer flexible member 26 includes a strap that includes a substantially flat and elongated strip of textile. The flexible member 26 might be affixed to the cuff 14 in various manners, and FIGS. 1 and 2 depict an exemplary aspect in which an edge 27 of the flexible member 26 is affixed to the cuff 14. For example, the edge 27 might be sewn or adhered to the cuff 14. Affixing the edge 27 to the cuff 14 helps to bias the flexible member 26 in an orientation that is aligned with the releasable fastener 24.

Figure 3:
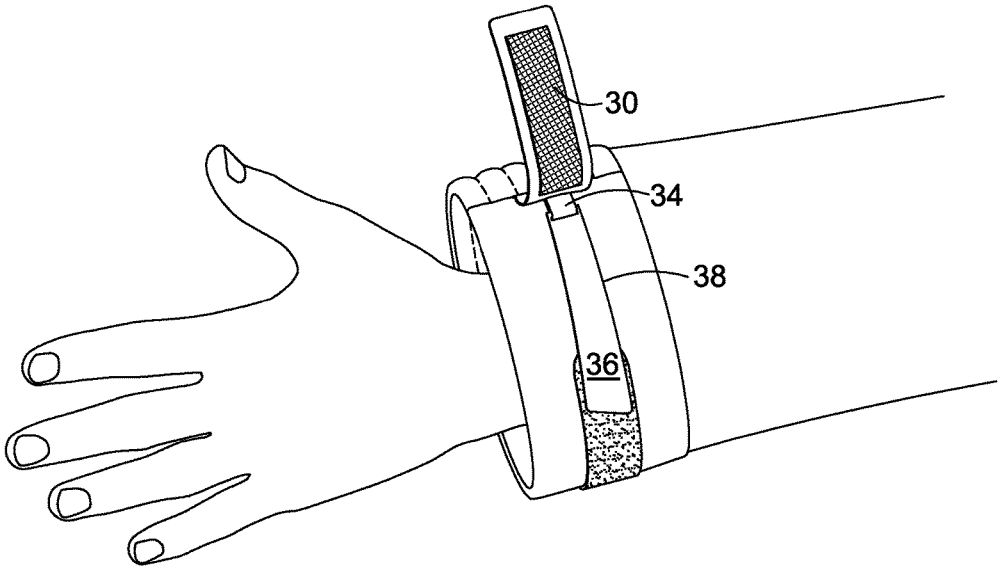
Figure 4:
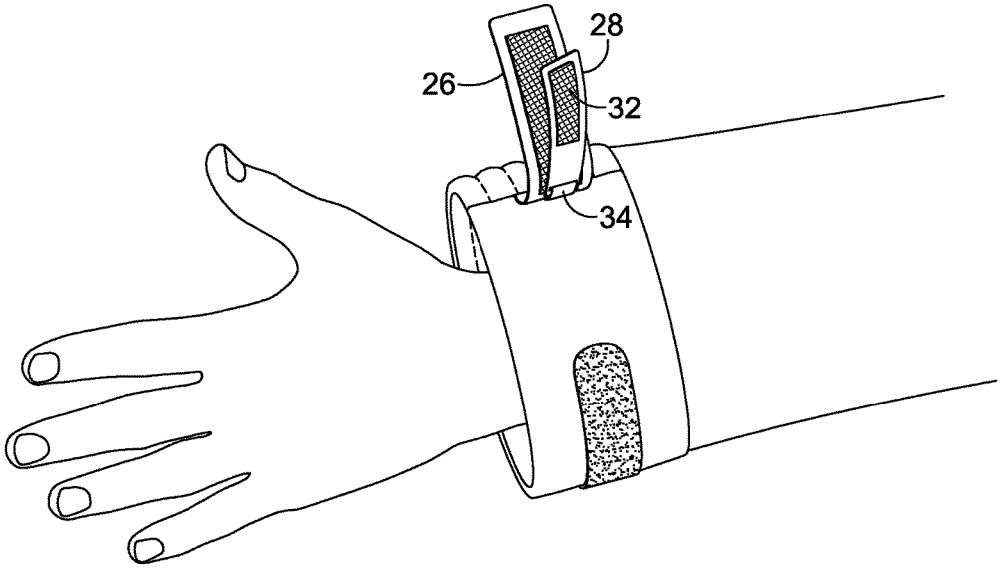

Referring now to FIGS. 2, 3, and 4, the outer flexible member 26 is disconnected from the releasable fastener 24 and folded back to reveal an inner flexible member 28, which is also attachable to the releasable fastener 24. In the exemplary aspect depicted in these figures, both the outer flexible member 26 and the inner flexible member 28 include respective releasable fasteners 30 and 32 that mate with the releasable fastener 24. In addition, a surface 36 of the inner flexible member 28 might also mate with the releasable fastener 30 of the outer flexible member 26. For instance, the surface 36 might include a hook-and-loop strip or some other textile that mates with a touch-connection textile.

In one aspect the inner flexible member 28 includes a strap 38 that includes a substantially flat and elongated strip of textile and that is rotatably attached to the cuff 14 in various manners. The strap 38 might be rotatably coupled to the cuff using various attachment mechanism. For instance, flexible member 28 might be coupled to the cuff 14 by a tether 34 having a stiffness that is lower than the strap 38. The reduced stiffness of tether 34 (relative to the strap 38) might result from various factors. For instance, the tether 34 might be thinner than the strap 38 or might be cut narrower than the strap 38. Also, the inherent qualities of the tether 34 might result in a stiffness that is less than the strap 38. For example, the tether 34 might include an elastic textile that has a reduced stiffness or rigidity relative to the strap 38 and that allows the tether 34 to be stretchable. In such an aspect, the tether 34 provides an elastic joint that stretches and allows for side-to-side flexion, adjustment, and rotation of the flexible member 28. In one aspect, the elastic textile that is coupled to the strap 38 is contiguous with an elastic member 23 positioned in one or more of the tubes 22*a-f*. Alternatively, the elastic tether might be affixed to the cuff 14 independently of elastic in the tubes 22*a-f*.

Although FIGS. 3 and 4 depict an aspect in which the strap 38 is connected to the cuff 14 by way of the tether 34, other attachment mechanisms might be used that provide for side-to-side adjustment and rotation of the flexible member 28. For example, the flexible member 28 might be rotatably attached to the cuff 14 using a button fastener, snap fastener, brad fastener, or other rotatable coupling. These various attachment hardware might be used to attach the strap 38 directly to the cuff 14 or to attach a tether 34 to the cuff 14.

The flexible members 26 and 28 might serve various functions. For instance, the flexible members 26 and 28 might be wrapped at least partially around a portion of the cuff 14 and attached to the releasable fastener 24 to establish set a size of the cuff 14. In addition, the attachment of the flexible members 26 and 28 to the releasable fastener 24 is adjustable to make the cuff size bigger or smaller.

Figure 5:
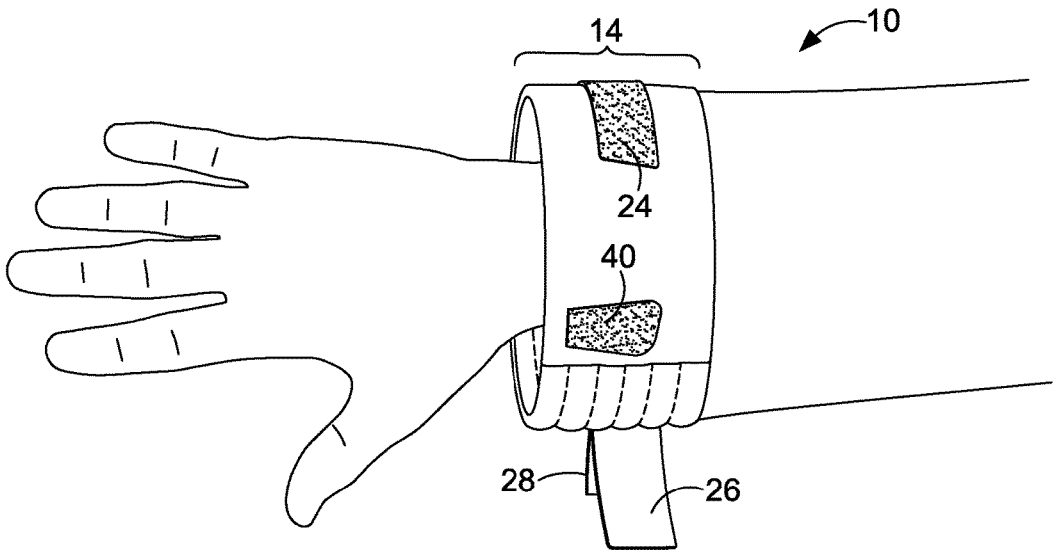
FIG. 5 depicts a second side of the sleeve in accordance with aspects hereof.

Referring now to FIG. 5, another side of the sleeve 10 and cuff 14 is depicted that is opposite to the side depicted in FIGS. 1-4. In FIG. 5 the releasable fastener 24 is again depicted, but from a perspective that is different from FIGS. 1-4. In addition, another releasable fastener 40 is illustrated spaced apart from the releasable fastener 24. The releasable fastener 40 is depicted as a hook-and-loop strip or another type of touch fastener, but a variety different releasable fasteners might also be used, such as button, snaps, and the like. In addition, although the releasable fasteners 24 and 40 are illustrated as spaced apart, they might be combined into a single releasable fastener that spans the portion of the cuff 14 therebetween.

Figure 6:
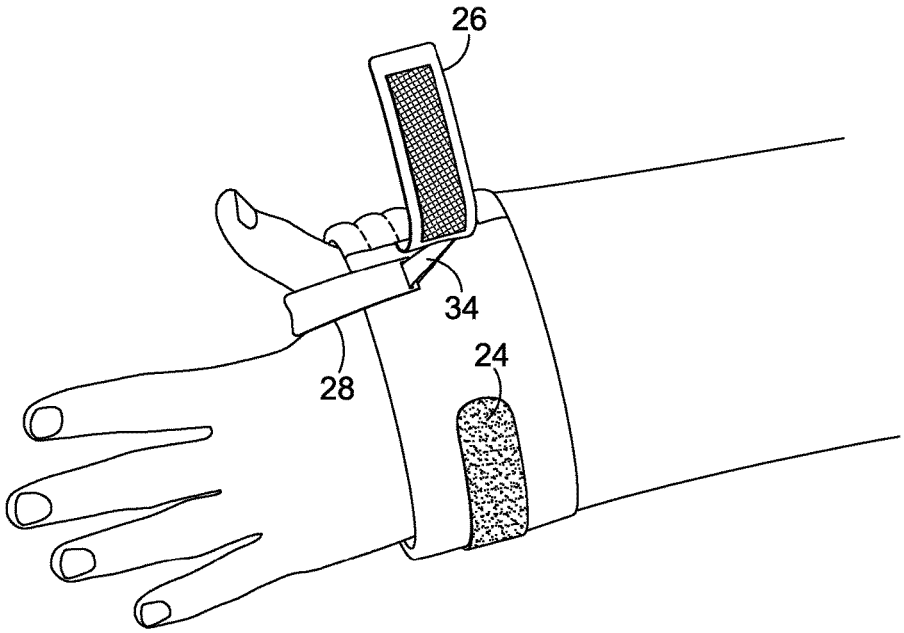
FIG. 6 depicts the first side of the sleeve with the second strap providing a thumb loop in accordance with aspects hereof.
Figure 7:
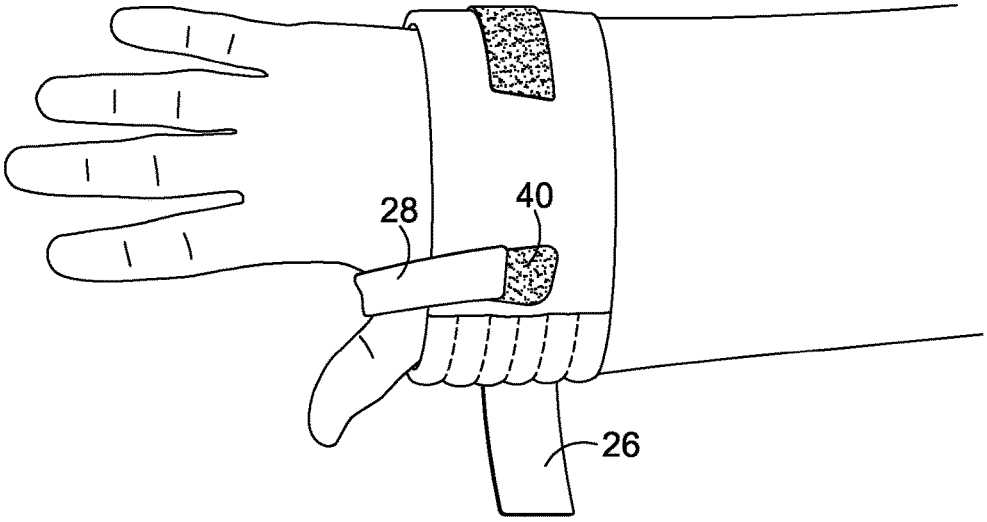
FIG. 7 depicts the second side of the sleeve with the second strap providing the thumb loop in accordance with aspects hereof.
Figure 8:
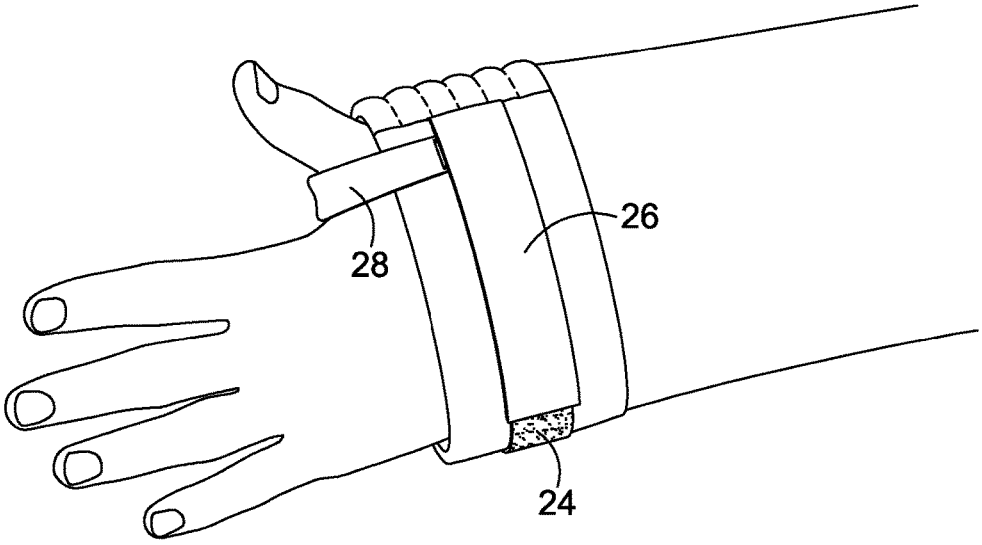
FIG. 8 depicts the first side of the sleeve with the second strap providing the thumb loop and the first strap.

FIGS. 6, 7, and 8 illustrate exemplary aspects hereof that will now be described, and in describing FIGS. 6, 7, and 8, other figures are also referenced. For instance, FIG. 1 depicts an aspect in which the outer flexible member 26 and the inner flexible member 28 (not viewable in FIG. 1) are in a stacked arrangement. That is, in FIG. 1, the outer flexible member 26 overlays the inner flexible member 28 and is attached to the releasable fastener 24 and possibly to the inner flexible member 28. In this stacked arrangement, the attachment of the flexible members 26 and 28 to the releasable fastener 24 is adjustable to modify a size of the cuff 14 (i.e., to make the cuff fit tighter or looser). In FIG. 4 the flexible members 26 and 28 are disconnected from the releasable fastener 24. In FIGS. 6, 7, and 8, the inner flexible member 28 has been rotated on the tether 34, and the inner flexible member 28 is no longer in the stacked arrangement as depicted in FIG. 1. Rather, in FIGS. 6, 7, and 8 the inner flexible member 28 is splayed relative to the outer flexible member 26 and is attached to the releasable fastener 40, as shown in FIG. 7. FIG. 8 further depicts an aspect in which the outer flexible member 26 is releasably attached to the releasable fastener 24, while the inner flexible member 28 is splayed. In this arrangement depicted in FIG. 8, the inner flexible member 28 provides a thumb loop for securing the cuff 14 and sleeve 10 to a wearer.

In another aspect, when the outer flexible member 26 and the inner flexible member 28 are in a splayed configuration, the inner flexible member 28 might attach to the releasable fastener 24 that is depicted in FIG. 7. In such an arrangement, attachment to the releasable fastener 24 might provide a more secure fit. Further, the outer flexible member 26 might be wrapped tighter around the cuff 14 to provide a more secure fit.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. An apparel arm sleeve comprising:

a tubular sleeve body that extends from a torso portion and that includes a terminating end having an opening through which a hand may extend when the apparel arm sleeve is worn;

one or more releasable fasteners coupled to the tubular sleeve body near the terminating end;

a first flexible member coupled to the tubular sleeve body near the terminating end and releasably attachable to the one or more releasable fasteners; and a second flexible member rotatably coupled to the tubular sleeve body near the terminating end and releasably attachable to the one or more releasable fasteners, wherein the second flexible member is movable between a first position and a second position, and wherein:

when the second flexible member is in the first position it is releasably attached to the one or more releasable fasteners and is stacked with the first flexible member, and when the second flexible member is in the second position it is rotated relative to the first position and is releasably attached to the one or more releasable fasteners so that the second flexible member divides the opening of the tubular sleeve body to form a thumb loop designed to receive a thumb of a wearer when the apparel arm sleeve is worn.

2. The apparel arm sleeve of claim 1, wherein the one or more releasable fasteners comprise at least a portion of one or more hook-and-loop fastening systems.

3. The apparel arm sleeve of claim 1, wherein the terminating end of the tubular sleeve body encloses a first volume of space, and wherein attachment of the first flexible member to the one or more releasable fasteners is adjustable to modify the first volume of space.

4. The apparel arm sleeve of claim 1, wherein the terminating end of the tubular sleeve body includes a cuff having an outer fabric layer and an inner fabric layer and wherein one or more elastic members are positioned between the outer fabric layer and the inner fabric layer.

5. The apparel arm sleeve of claim 4, wherein the second flexible member is coupled to at least a portion of the one or more elastic members and attaches to the one or more releasable fasteners on an outside surface of the outer fabric layer.

6. The apparel arm sleeve of claim 5, wherein the at least the portion of the one or more elastic members rotatably couples the second flexible member to the tubular sleeve body.

7. The apparel arm sleeve of claim 1 further comprising, an elastic joint that rotatably couples the second flexible member to the tubular sleeve body.

8. A cuff for an apparel sleeve comprising:

a cuff wall;

one or more releasable fasteners coupled to an outer surface of the cuff wall;

an outer flexible member coupled to the outer surface and releasably attachable to the one or more releasable fasteners, wherein attachment of the outer flexible member to the one or more releasable fasteners is adjustable to modify a size of the cuff; and an inner second flexible member rotatably coupled to the cuff wall and designed to be releasably attached to the one or more releasable fasteners, wherein the inner flexible member is rotatable between a first position and a second position, wherein in the first position the inner flexible member is substantially aligned with the outer flexible member in a stacked position in which the inner flexible member is positioned below the outer flexible member and is releasably attachable to the one or more releasable fasteners, and wherein in the second position, the inner flexible member is rotated relative to the first position and attachable to the one or more releasable fasteners to provide a thumb loop designed to receive a thumb of a wearer when the apparel arm sleeve is worn.

9. The cuff of claim 8 further comprising, an elastic joint that rotatably couples the inner flexible member to the cuff wall.

10. The cuff of claim 8, wherein the cuff wall includes an outer fabric layer and an inner fabric layer and wherein one or more elastic members are positioned between the outer fabric layer and the inner fabric layer.

11. The cuff of claim 10, wherein the inner flexible member is coupled to at least a portion of the one or more elastic members, and wherein the at least a portion of the one or more elastic members provides a rotatable coupling of the inner flexible member to the cuff.

12. The cuff of claim 8, wherein the outer flexible member includes a substantially flat body having a cuff-facing surface that faces towards the cuff when the outer flexible member is releasably attached to the one or more releasable fasteners, and wherein the cuff-facing surface includes another releasable fastener that releasably attaches to the inner flexible member.

13. A cuff for an apparel arm sleeve comprising:

a cuff wall;

one or more releasable fasteners coupled to an outer surface of the cuff wall;

a first strap comprising a first substantially flat and elongated fabric strip, wherein the first strap is attached along a first edge directly to the outer surface of the cuff wall and is releasably attachable to the one or more releasable fasteners, and wherein attachment of the first strap to the one or more releasable fasteners is adjustable to modify a size of the cuff; and a second strap comprising a second substantially flat and elongated fabric strip, wherein the second strap is coupled to an elastic joint, which rotatably attaches the second strap to the cuff wall, and wherein the second strap adjusts by way of an elastic joint between at least a first position, in which the second strap is substantially aligned and stacked with the first strap and attached to the one or more releasable fasteners, and a second position, in which the second strap is rotated relative to the first position and attached to the one or more releasable fasteners, and wherein when the second strap is in the second position, the second strap is rotated to form a thumb loop designed to receive a thumb of a wearer when the apparel arm sleeve is worn.

14. The cuff of claim 13, wherein the first and second straps include a component of a hook-and-loop fastening system, and wherein the first strap releasably fastens over the second strap when the second strap is in the first position.

15. The cuff of claim 13, wherein the cuff wall includes one or more elastic members coupled between an outer fabric layer and an inner fabric layer, and wherein at least a portion of the one or more elastic members attaches to the second strap to provide the elastic joint.

* * * * *